United States Patent [19]

Martini

[11] Patent Number: 4,592,189

[45] Date of Patent: Jun. 3, 1986

[54] APPARATUS FOR CLOSING AND SEALING TELESCOPING BOXES

[76] Inventor: Phillip J. Martini, 1615 Crestview Dr., Oshkosh, Wis. 54901

[21] Appl. No.: 546,658

[22] Filed: Oct. 28, 1983

[51] Int. Cl.[4] ..... B65B 61/00

[52] U.S. Cl. ..... 53/137; 156/486

[58] Field of Search ..... 53/137; 156/468, 475, 156/486, 487, 488, 492, 523, 574, 577

[56] References Cited

U.S. PATENT DOCUMENTS

| | | | |
|---|---|---|---|
| 2,317,943 | 4/1943 | Salfisberg | 156/486 |
| 2,726,783 | 12/1955 | Erickson | 156/486 |
| 3,174,891 | 3/1965 | Drew | 156/486 |
| 3,491,657 | 1/1970 | Feigel | 53/137 X |
| 3,561,190 | 2/1971 | Derenthal | 156/486 X |
| 3,866,812 | 2/1975 | Gutjahr | 156/468 X |
| 4,039,367 | 8/1977 | Warshaw et al. | 156/486 |

*Primary Examiner*—John Sipos
*Assistant Examiner*—Steven P. Weihrouch

[57] ABSTRACT

An apparatus for closing and sealing telescoping boxes includes a ram for pressing the top of the box downwardly over the bottom of the box and a vertically movable box support plate which lowers during the box closing process. Four tape heads seal the four sides of the box while it is in the lowered position. The plate then moves to its upward position for removal of the closed and sealed box and for receiving the next box to be closed and sealed.

20 Claims, 12 Drawing Figures

APPARATUS FOR CLOSING AND SEALING TELESCOPING BOXES

BACKGROUND OF THE INVENTION

1. Field of the Invention

The present invention relates generally to the art of apparatus for closing and sealing boxes and more particularly to machines for closing telescoping boxes and sealing the edges thereof.

2. Description of the Prior Art

Many different types of machines are known to the art for sealing boxes. The present invention deals primarily with telescoping corrugated containers, so the prior art will be described primarily with reference to apparatus used with such boxes. A telescoping box is one which includes two separate parts, a top and a bottom. The bottom part has a flat bottom and four side walls extending upwardly therefrom. The top part has a flat top and four side walls extending downwardly therefrom. The depth of the side walls of the top and bottom portions are substantially the same. The top is just slightly larger than the bottom so that it can be placed thereover and pressed down to form a closed box with double thickness sides. Sealing of the box takes place after the two parts are "telescoped" to their closed position, e.g., by taping, strapping and the like.

These types of boxes are different from the somewhat more conventional flap-type corrugated containers and have particular utility in numerous industries for packing a wide variety of products. Telescoping boxes are used for packing and shipping clothing, produce, appliances and the like. Products packaged in such boxes are protected by the double side wall thickness and, to a limited extent, the loading of the boxes is easier because the labor force need not be concerned with the flaps of standard corrugated shipping containers.

While the use of telescoping boxes is quite widespread, there are several problems in the closing and sealing thereof which have not been resolved in the prior art. These problems relate to automation of these processes. The problems can best be illustrated by reference to one typical process now being used to close and seal such boxes. In this process, clothing to be packaged and shipped is placed in the bottom portion of the box and the top portion is placed loosely thereover. The filled box moves down a conveyor to a closure and strapping station where an operator manually pushes the top down over the bottom. The box is then aligned in a strapping machine which subsequently wraps a band of plastic material around two sides and the top and bottom of the box, cuts the plastic and joins the ends of the plastic strap. At this point in the process, the sealing machine opens and the operator reaches in the machine and rotates the partially sealed box 90°. The strapping machine then wraps another band of plastic over the top and bottom and around the other two sides of the box, cuts the plastic and joins the ends thereof to complete the seal.

The aforementioned process has several important disadvantages. For one thing, the process is labor intensive in that a full-time operator is required for the machine, i.e. to rotate the box after each one-half of the closing and sealing process. This manipulation is also time consuming because the wrapping step is much faster than the manipulation step. In plants having a large number of boxes to be closed and sealed, the time required for rotating individual boxes may even lead to the need for a larger number of machines than would be required if the time consuming step was not present. Another problem with this particular prior art process and apparatus, is the material cost for the plastic band. These costs may amount to five-six cents or more for medium size boxes.

Other techniques are also being employed by manufacturers for closing and sealing telescoping boxes. Many plants are still conducting the operation by hand using hand taping machines. In effect, this process involves the use of hand held taping guns which dispense a preselected length of tape. The operator presses the tape onto one edge of a side wall to affix the tape and then pulls tape from a tape roll as the gun is drawn down the side and under the bottom of the box. When a preselected amount of tape has been removed from the roll, a cutter on the tape machine slices the tape and prepares a new piece of tape for the next sealing operation. This process is also very labor intensive and inefficient.

To the knowledge of the present inventor, there are no known machines which have the capability of quickly and cheaply closing and sealing the four edges of a telescoping box without the need for extensive manual operations or the need to manipulate (e.g., rotate) the box. A device for simultaneously closing and sealing telescoping boxes would be a significant advance in the art.

OBJECTS AND SUMMARY OF THE INVENTION

A primary object of the present invention is to provide an apparatus for closing and sealing telescoping boxes which overcomes the aforementioned disadvantages of the prior art.

Another object of the present invention is to provide an apparatus for closing and sealing telescoping boxes in which all four edges of the box are sealed with tape at the same time and without the need for rotation of the box.

A further object of the present invention is to provide an apparatus for closing and sealing telescoping boxes which requires a minimum amount of operator labor and which, for all practical purposes, can be fully automated for continuous operation.

A still further object of the present invention is to provide an apparatus for closing and sealing telescoping boxes which employs tape and which reduces material costs when compared to plastic strap apparatus.

A different object of the present invention is to provide an apparatus for closing and sealing telescoping boxes which includes a vertically moving platform to allow simultaneous four-edge box sealing.

Yet another object of the present invention is to provide an apparatus for closing and sealing telescoping boxes which is readily adaptable to boxes of different sizes and shapes.

A further object of the present invention is to provide an apparatus for closing and sealing telescoping boxes which performs the closing and sealing operations very quickly, e.g., in about 10 seconds or less.

How these and further objects of the invention are accomplished will be described by reference to the following description of a preferred embodiment of the invention taken in conjunction with the FIGURES. Generally, however, the objects are accomplished in an automatic machine having a conveyor system for bringing a box to a work station and aligning same with respect to the operative components of the apparatus. As the box enters the apparatus, the top of the telescoping box is placed over, but need not be completely depressed over, the lower part of the box. At the work station, a vertically movable platform is provided, above which is a pneumatic cylinder having a piston directed toward the platform and having a compressing plate located at its lower end. Once the box is in position, the box and support platform are lowered to a location below the plane defined by the box conveyor system. The cylinder is extended to cause the compressing plate to press against the top of the box to complete the closing procedure. Four tape heads are located below the conveyor plane, which themselves are movable from first position where the tape is located below the box and within the area defined by the bottom thereof. When the box is lowered and when the top compression ram is extended, the tape is pressed onto the bottom of the box. At this point, the tape heads retract to apply tape to the bottom of the box in a direction leading to each of the four side edges. Follow rollers press the tape onto the box. When the tape heads reach the edges, tape is cut from tape rolls and the follow rollers, which are spring loaded, apply the tape onto the side walls of the box and upwardly from the bottom to complete the sealing operation. The platform then raises, the compression cylinder is retracted and the box is removed by the conveyor system to make the apparatus ready to receive the next box. Variations of the preferred embodiment which provide different ways of accomplishing the objects of the invention will also be described. Other variations may appear to those skilled in the art after reading this specification and are deemed to fall within the scope of the present invention if they fall within the scope of the claims which will follow the description of the preferred embodiment.

DESCRIPTION OF THE PREFERRED EMBODIMENT

Figure 1:
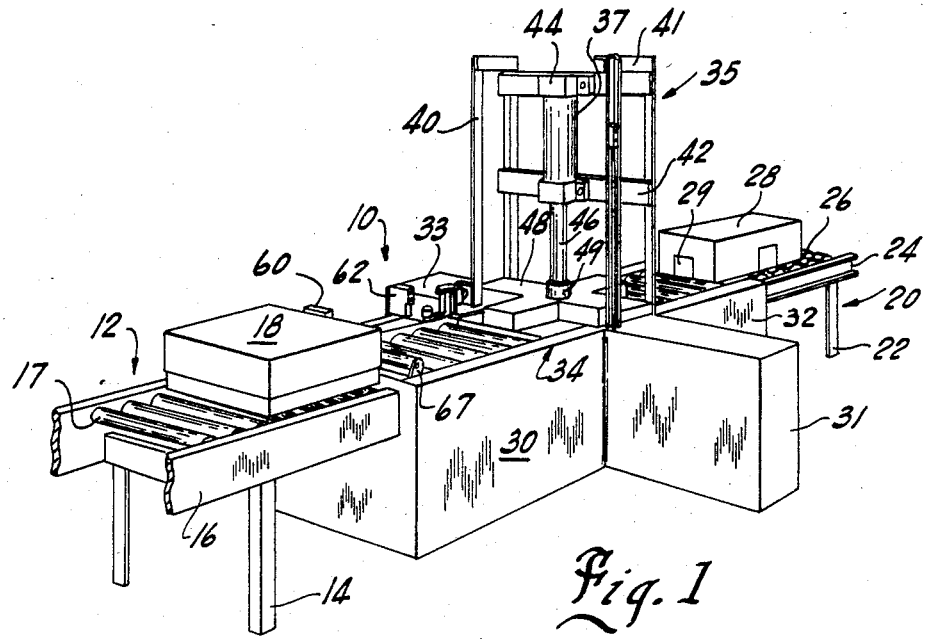
FIG. 1 is a perspective view of an apparatus for closing and sealing telescoping boxes according to the preferred embodiment of the present invention.

A general understanding of the apparatus 10 for closing and sealing telescoping boxes according to the preferred embodiment of the present invention may be obtained by reference to FIG. 1. Apparatus 10 is located between a conveyor for bringing closed, but not compressed boxes to the machine and another conveyor for carrying the closed, compressed and taped boxes away from apparatus 10.

The infeed conveyor 12 includes legs 14, sidewalls 16 and parallel and spaced-apart conveyor rollers 17. Drive means (not shown) are provided for driving the rollers so that a box 18 may be moved to apparatus 10. Box 18 is of the telescoping variety and has been loaded with product prior to the point shown in the FIGURE. As seen in this FIGURE, the top has been placed over the bottom of the box, but the box has not been fully compressed.

The downstream conveyor 20 also includes legs 22 and side rails 24 but in this particular embodiment includes a bed of ball bearings 26 in lieu of the rollers. The box 28 shown on conveyor 20 has been fully compressed and four pieces of tape 29 have been applied, one on the mid-point of each bottom edge. Box 28 has been prepared by apparatus 10 for the downstream handling operations of labeling, weighing and shipping. The conveyors 12 and 20, in and of themselves, form no part of the present invention and have been illustrated in general form for the sole purpose of explaining the operations and use of apparatus 10.

Figure 2:
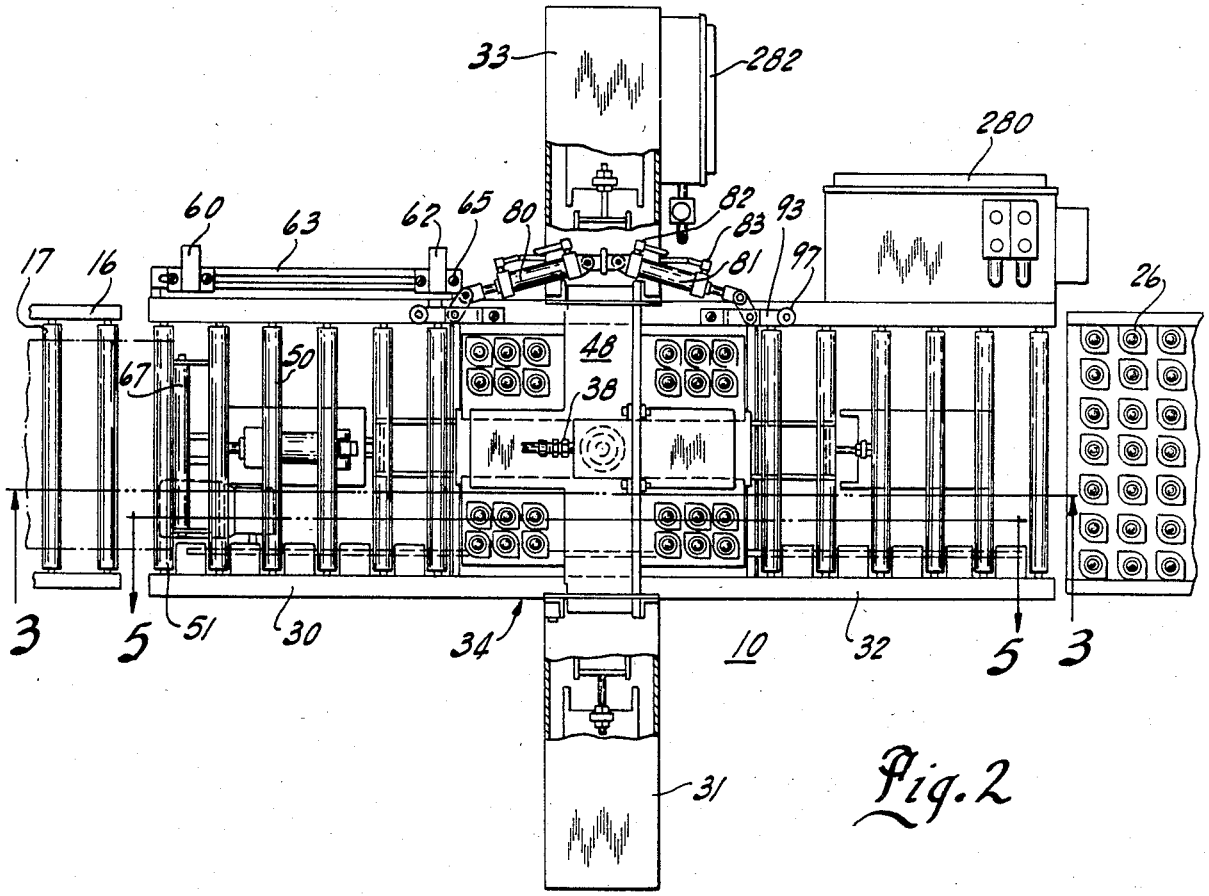
FIG. 2 is a top plan view of the apparatus shown in FIG. 1 with parts cut away to show some of the internal features.

Apparatus 10 includes a generally cross-shaped base having cabinets 30, 31, 32 and 33 which will be explained later. Apparatus 10 also includes an upper frame 35 surrounding and extending upwardly from the center portion 34 of the machine, the frame supporting a cylinder 37 used during the box closing procedure. Frame 35 includes four vertical support posts 40, each of which has its lower end attached to the top of the base 29. The tops of adjacent pairs of posts 40 are joined by top braces 41 and a pair of horizontal braces 42 are provided between one pair of posts 40. A support bracket 44 is attached to each of braces 42, the latter in turn supporting cylinder 37. Cylinder 37 is arranged vertically and has a piston 46 extending from its lower end which may be retracted into or extended from cylinder 37. The fittings 38 for admitting and exhausting air from cylinder 37 are shown in FIG. 2. Details are not provided because the cylinder, in and of itself, is well known and one skilled in the art would readily appreciate the details of same after reading this specification.

Cylinder 37 is an air cylinder in the illustrated embodiment, and while air cylinders are used throughout this description and are preferred by the inventor, it will be obvious to those skilled in the art that hydraulic cylinders may also be employed. The length and stroke of piston 46 are selected for the particular type of box with which apparatus 10 will be used. For example, the braces 42 may have an adjustable feature. Generally, the piston 46 should be of sufficient length to allow a pressure plate 48 affixed to the end thereof to be moved so that its lower surface is generally planar with the top surface of base 29. This statement is true with respect to the boxes illustrated in the FIGURES, but may not be true for thinner or thicker boxes.

Pressure plate 48 is cross-shaped in the illustrated embodiment but may be of any other shape so long as it permits even pressure to be applied by the cylinder 37, piston 46 and plate 48 over the area 34 at the center of apparatus 10. Accordingly, piston 46 will have its axis coinciding with a vertical line drawn through such center section. Plate 48 is attached to piston 46 using a collar 49 affixed to the upper surface of plate 48 and a set screw (not shown). By varying the height of collar 49, another system for adjustment of piston length height can be provided.

Figure 5:
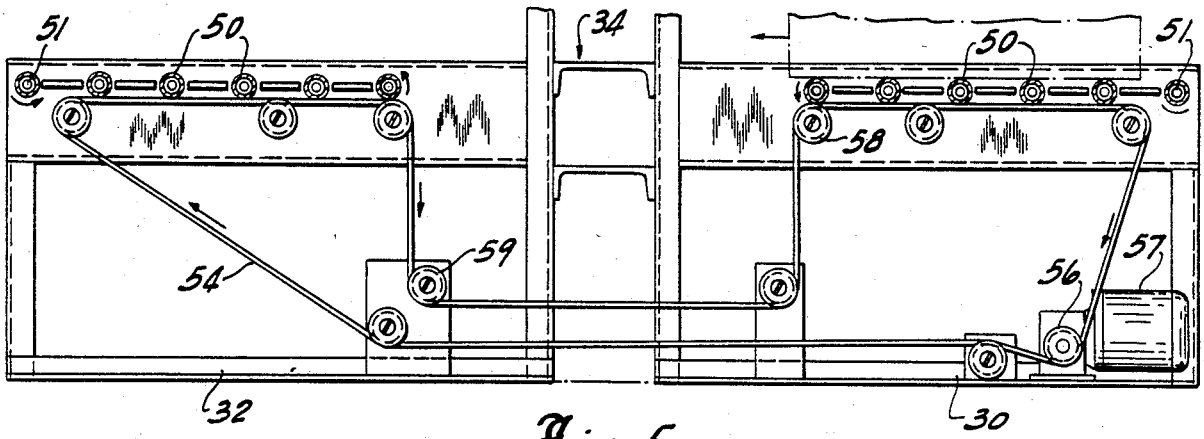
FIG. 5 is a view taken along the line 5—5 of FIG. 2 showing the belt drive of the conveyor rollers.

Moving next to FIG. 2, the box flow system used in the preferred emodiment of the present invention will be described. As previously mentioned, the infeed conveyor brings a box to the outside edge of cabinet 30 of apparatus 10. The flow system is designed to admit one box at a time to apparatus 10. To this end, the top surface of cabinets 30 and 32 include a plurality of spaced-apart and driven conveyor rollers 50, five such rollers being shown over cabinet 30 and six such rollers being shown over cabinet 32. A free running roller 51 is also provided at the outside end of cabinet 30 at the junction thereof with conveyor 12. The drive system for rollers 50 is illustrated in FIG. 5 and includes an endless belt 54 driven by a pulley 56 connected to a motor 57. Conventional couplings, speed reducers and the like may be employed as is known to the art. A plurality of other pulleys are located in cabinets 30 and 32 so that proper tension on belt 54 is maintained and so that the belt 54 is maintained in contact with rollers 50 to drive same in the direction shown in FIG. 5. As will be more fully appreciated later in this description, belt 54 is diverted downwardly in the vicinity of section 34 of apparatus 10 by a set of lower pulleys 59.

The roller system shown is again for purposes of illustration as a number of conveyor drive systems are known in the art, e.g., chain drives, etc. Also, the number of rollers 50 and their size is for purposes of illustration, and it should be understood that any conveyor system which will pick up a box at the edge of cabinet 30, drive it to the center section 34 and remove it from centers section 34 and drive it to the outside edge of cabinet 32 would be suitable here. While the center sections 34 does not include driven conveyors, the apparatus of present invention is designed so that a moving box will stop within section 34 after being moved by rollers 50 and so that a subsequent box moving into section 34 will push the sealed box out onto rollers 50 at cabinet 32 to be removed from the machine.

Figure 3:
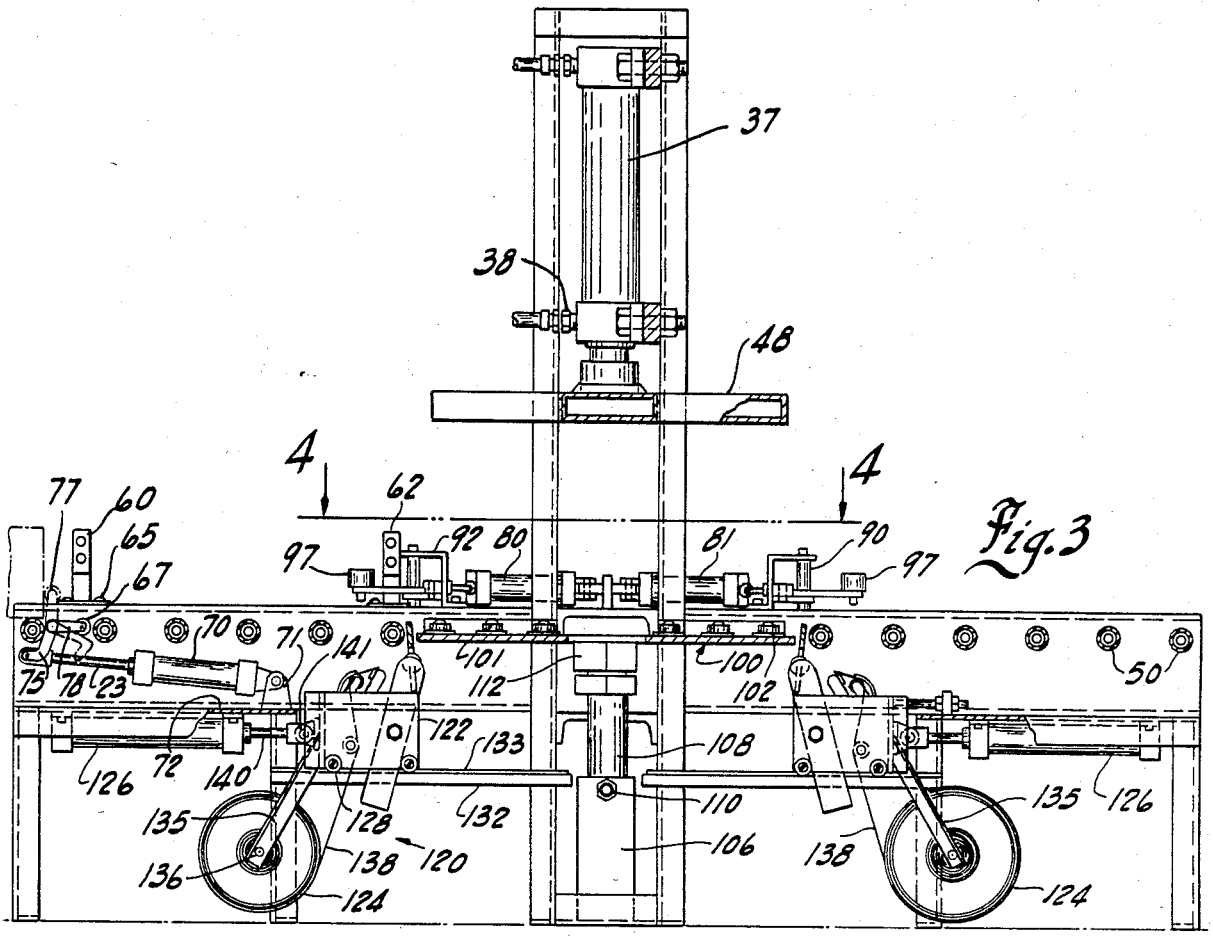
FIG. 3 is a sectional view taken along the line 3—3 of FIG. 2.

Because apparatus 10 is designed as an automatic and continuously operating machine, a system has been built into the device for stopping the upstream boxes while the closing and sealing operations take place. This system is best illustrated in FIGS. 2 and 3. Control for such system is provided by a pair of electric eyes 60 and 62 which are movably mounted along a top edge of cabinet 30 on a track member 63. A pair of set screws 65 are provided for each electric eye so that they may be rigidly locked in track 63 at preselected locations. The distance between electric eyes is set by the operator for the particular size box used on apparatus 10, the spacing required being just slightly less than the length of the box.

The electric eyes 60 and 62 are of any conventional type which emit a light ray and have a receiving surface for detecting reflection of such light ray if an object is placed in the path of the ray, in this instance, one of the boxes. In the present system, it will be apparent that as the box moves along rollers 50, a situation will exist where the box is adjacent to both electric eyes and the rays emitted therefrom will be reflected back to both eyes. As explained later in this specification during the descriptions of the air and electric systems, this situation causes a switch to open to cause a restraint gate 67 to block entry of additional boxes into the area over cabinet 30, as is illustrated at FIG. 1.

Gate 67 is also shown in FIG. 3 and is operated by an air cylinder 70 pivotably mounted to a bracket 71 on a horizontal surface 72 located beneath and spaced apart from rollers 50. Cylinder 70 is arranged generally horizontally and is directed toward conveyor system 12. It includes an extensible piston 73 movable between an extended position shown in full line in FIG. 3 and a retracted position. A lever arm 75 is rotatably mounted to the free end of piston 73 and is in turn coupled to an elongated rod 77 extending between the sidewalls of cabinet 30 at a location between roller 51 and the adjacent roller 50. Gate 67 is mounted to rod 77 and is spaced-apart therefrom by arms 78 so that it rotates between the full and dotted line positions shown in FIG. 3 depending on whether piston 73 is extended or retracted.

From the foregoing description, it will be apparent that gate 67 will rise to prevent entry of a second box over cabinet 30 when a first box has caused blocked both electric eyes which in turn has caused the retroaction of piston 73. Upon completion of the box closing and sealing operations, another signal will be generated to cause extension of the piston 73, lowering of gate 67 and the admission of the next box to the apparatus 10.

As with the conveyor systems previously described, a variety of modifications of the gate system are possible and are deemed to fall within the scope of the present invention. For example, mechanical switches extending into the path of box travel or passing upwardly between the spaced-apart rollers might be used for sensing box location and generating the gate closing signal. Alternately, the gate itself could take a variety of forms.

Figure 4:
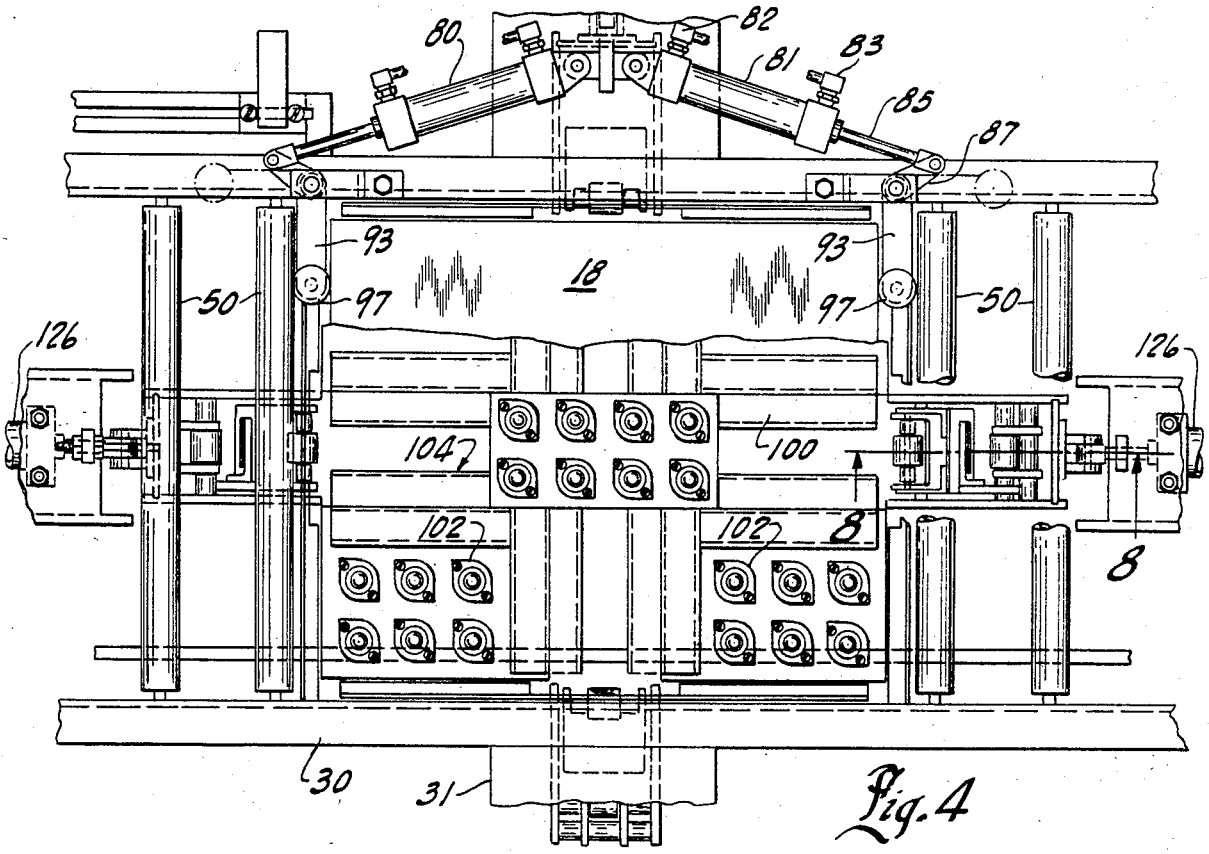
FIG. 4 is a top plan view taken along the line 4—4 of FIG. 3 showing the center section of the apparatus shown in FIG. 1 with a box shown centered by centering arms but not compressed, and showing the tape heads in their retracted positions.

Another feature of the present invention is shown in FIGS. 2–4 and relates to aligning the box properly within center section 34 of apparatus 10. The system includes two further air cylinders 80 and 81 having suitable fittings 82 and 83 for admitting and exhausting air therefrom. Cylinders 80 and 81 are mounted horizontally in the area of the junction of section 34 and cabinet 33 so that their bases are on top of cabinet 33 and so that the cylinder bodies extend angularly therefrom toward the nearest side rails of cabinets 30 and 32 respectively. Cylinders 80 and 8I each include an extensible piston 85 having the first end of a short lever arm 87 coupled to the free end thereof. The lever arm 87 is in the form of a plate having a hole at its second end. The hole is received by a vertical post 90 mounted to the frame of apparatus 10 at the junction of area 34 and cabinet 33, post 90 is secured by a bracket member 92.

Another lever arm 93 having a similarly shaped hole at one end thereof is also placed over post 90 and is welded or otherwise secured to lever arm 87 so that rotation of one lever arm causes rotation of the other. Finally, roller 97 is rotatably mounted to the other end of lever arm 93, the axis of rotation of roller 97 being vertical. The angle between the cylinders 80 and 81 and the coupling of the lever arms 87 and 93 is such that upon extension of the pistons 85 the roller 97 is moved from the position shown in FIG. 2 (where lever arm 93 is generally parallel to the box travel path) to the position shown in FIG. 4 (where the lever arms 93 are generally perpendicular and intersect the bar travel path). It will also be apparent from FIG. 4 that the box will be centered by the rollers 97 during such movement.

As best shown in FIGS. 3 and 4, apparatus 10 includes a vertically movable box support plate 100 which generally is located in portion 34. Support plate 100 is composed of a metal base 101 supporting five groups of ball bearings 102, one group located at each corner of plate 100 and one located at the center thereof. In the illustrated embodiment, six bearings are provided for each corner group while eight bearings are provided in the center group. The bearings are not described in detail because their sole function is to provide smooth movement of the box into and out of the center portion 34 of apparatus 10. Support plate 100 also includes four slots 104, one located at the center of each side and extending inwardly from such side toward the center bearing group. Slots 104 are provided so that tape may be applied to a box supported on plate 100. They must therefore be wider than the width of the tape to be used and must extend inwardly from the side edges of plate 100 by a distance equal to or greater than the length of tape to be applied on the bottom of the box. Movement of support plate 100 is accomplished by a cylinder 106 located below portion 34 and having its axis coinciding with that of cylinder 37.

Cylinder 106 includes a piston 108 and an inlet means and outlet means 110 (only the outlet being shown) so that piston 108 may be extended or retracted in a vertical direction. Piston 108 is coupled to support plate 100 by means of a collar 112 and set screw means (not shown). From the foregoing description, it should now be appreciated that the stroke of piston 108 will be such that support plate 100 will be moved from its normal position shown in FIG. 3 (where the surface Of bearings 102 are coplanar with the entrance and exit conveyor rolls) to a lowered position shown in FIG. 6 where the surface of bearings 102 is substantially below the aforesaid conveyor level, i.e. to a level which is equal to or approximates the level of support surface 72 on which gate cylinder 70 is mounted. The particular length of the stroke is not critical as long as support plate 100 is moved far enough below the surface level of apparatus 10 to permit the tape heads soon to be described to apply tape simultaneously to the box. A series of spacer plates 113 are provided in area 34 to assist in the centering of the box 18.

Before proceeding to describe the tape heads themselves, the sequence of operation of some of the previously described components will now be in order, especially with regard to the support plate 100 and piston 108. As mentioned above, the gate 67 closes when eyes 60 and 62 are both blocked by the box. This, of course, does not stop movement of the box across apparatus 10 because of the moving conveyor rolls 50. The single box will be moved by rollers 50 to portion 34 where it will stop on plate 100. At this point, both eyes 60 and 62 are cleared and a series of operations are initiated. First the box is centered on plate 100 by the action of rolls 97, and piston 108 is retracted so that the plate 100 and the box located thereon are lowered to the bottom position (see FIG. 6). Piston 46 is extended at this point to urge pressure plate 48 down onto the box to push the cover down and over the bottom of the telescoping box.

Proceeding now to a description of the components which perform the other function of apparatus 10, i.e. the tape sealing function, reference should initially be made to FIG. 3. It should be mentioned here that four tape heads 120 are employed in apparatus 10, but since they are identical except for location, only one will be described in detail. For this purpose, the tape head 120 located within cabinet 30 will be described. Each tape head 120 includes three major components a housing 122, a tape roll 124 and an air cylinder 126 for movement of housing 122 in a horizontal direction.

Housing 122 will be described in greater detail hereafter, but for present purposes it will be sufficient to state that it comprises a box like housing having four rollers 128 at its bottom corners. The rollers 128 are supported upon a horizontal plate 132 having track guides 133 thereon so that head 122 may move horizontally toward and away from section 34 of apparatus 10.

The tape roll 124 is rotatably supported below tape head 120 on an angle bracket 135 attached to an end of housing 122. The tape roll 124 may be a normal roll of box sealing tape and rotates about shaft 136. Tape 138 is drawn therefrom toward housing 122 as will be described later.

Figure 7:
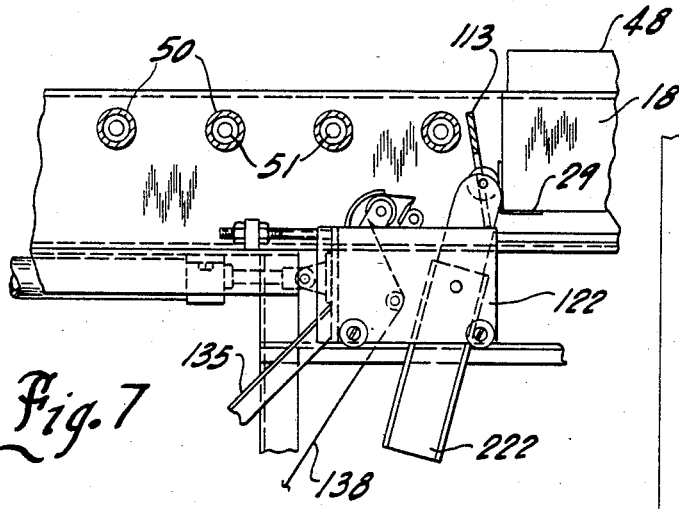
FIG. 7 is a partial view similar to FIG. 6 but with the tape heads retracted and showing a piece of tape applied to the bottom and side of the box.
Figure 6:
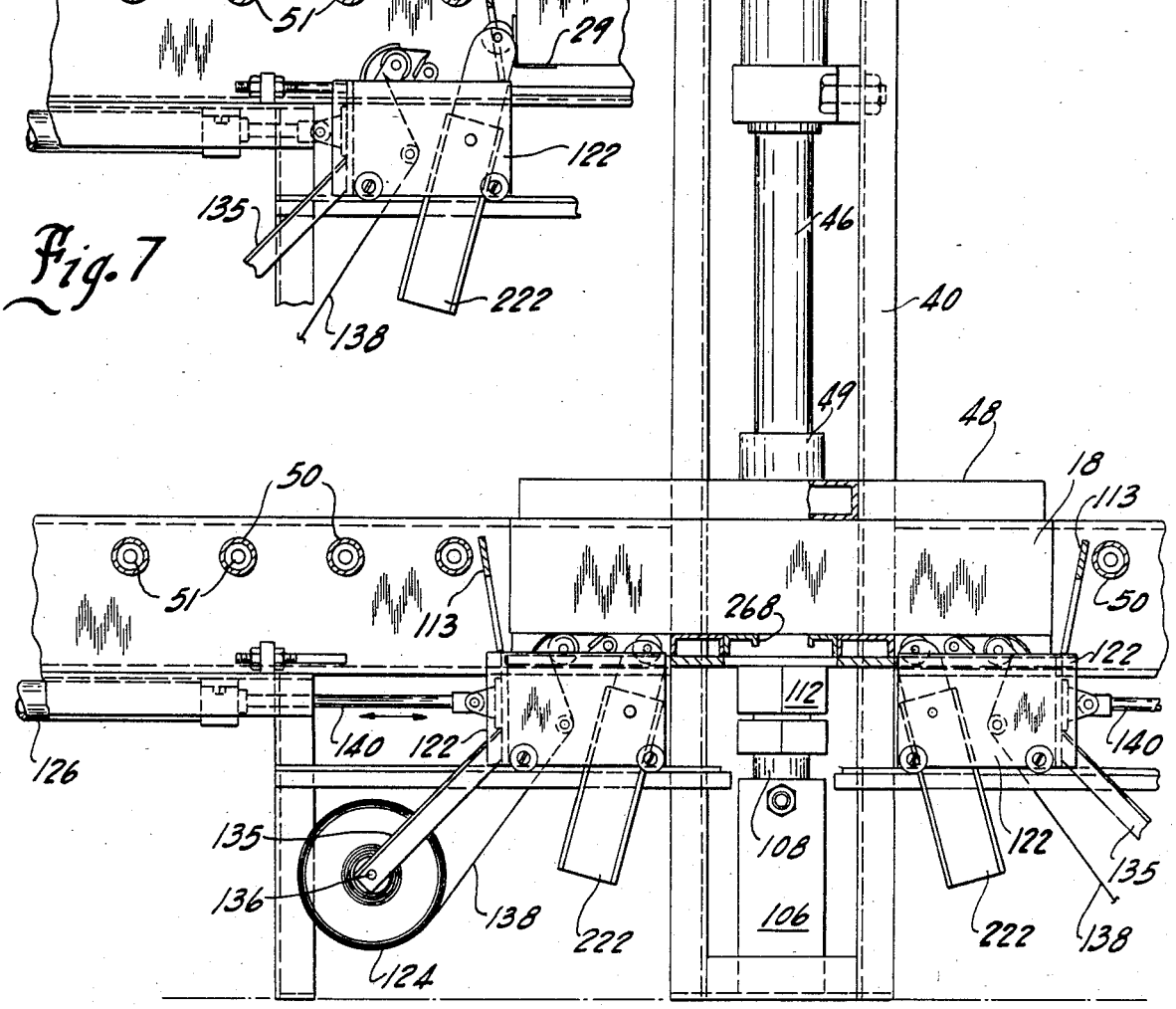
FIG. 6 is an enlarged view of the center section of the machine shown in FIG. 1 and illustrating a box in place which is compressed and the tape heads in the extended positions.

Cylinder 126 is mounted horizontally below surface 72 and has a piston 140 extending therefrom and coupled to housing 122. Normal air inlet and outlet coupling (not shown) are provided for cylinder 126 so that piston 140 may be retracted as shown in FIG. 3 or may be extended as shown in FIG. 6. In the extended position, housing 122 is located under the box 18. In actual operation of apparatus 10, controls are provided to cause extension of piston 140 at the same time the gate 67 is raised, i.e. before lowering of support plate 100 or extension of piston 46. This puts the tape head 120 in position to apply tape to the bottom of the box when the support plate is lowered and pressure is applied to box 18 by pressure plate 48. This position is shown in FIG. 6. When retracted, housing 122 travels to the location shown in FIGS. 3 and 7, and as can be seen in FIG. 7, a piece of tape 29 which has been severed from tape 138 is applied to both the bottom and side of the box 18 while the box remains in the lowered position. The operation of the tape heads !20 will be explained in greater detail hereafter, but once the sealing step has been completed, piston 108 is extended and piston 46 is retracted whereby the box 18 is returned to the plane of the surface of apparatus 10. Box removal from area 34 is then accomplished by lowering of gate 67 which starts the next sequence. The second box is admitted to rollers 50 and subsequently will push the already sealed box 18 out onto rollers 50 of cabinet 32 for subsequent handling. The second box will come to rest on support plate 100, etc.

Figure 8:
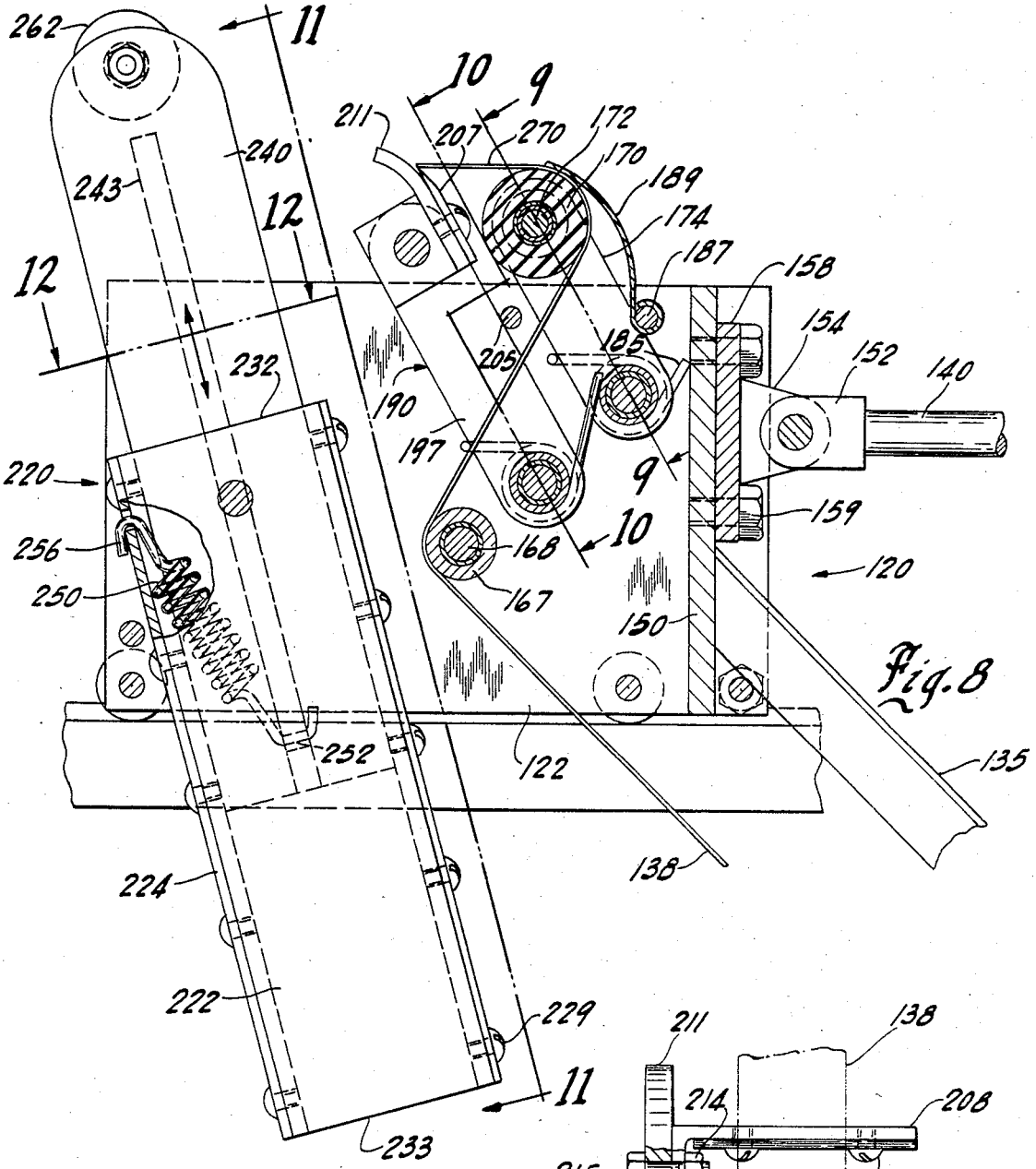
FIG. 8 is a cross section through a tape head used in the preferred embodiment of the present invention and showing a portion of the piston used to move the tape head.

The construction and operation of the tape heads 120 will be explained in connection with FIGS. 8–12. In FIG. 8, piston 140 is shown coupled to the end 150 of housing 122 by clevis 152, the latter being rotatably joined to a support bracket 154. Bracket 154 is perpendicularly attached to a plate 158 which is bolted by bolts 159 to end 150.

Housing 122 is generally rectangular in horizontal and longitudinal cross section and includes side walls 162 and 163, wall 162 being the near side wall as shown in FIG. 8. The top and bottom of housing 122 are open to allow the tape 138 to be fed up into housing 122 from the bottom and to allow a piece of the tape 138 to be applied to box 18 through the top of housing 122 in the manner now to be described.

Tape 138 enters housing 122 and travels generally toward the middle of housing 122 and passes around a free-running knurled roller 167 mounted on a shaft 168, the latter being mounted between walls 162 and 163. The tape 138 is thus redirected toward the top of end plate 150 and actually passes outwardly from the top of housing 122. At this point, the tape passes around another roller 170. This roller is used to apply the tape to the box bottom and is preferably constructed from a resilient material, such as rubber.

Figure 9:
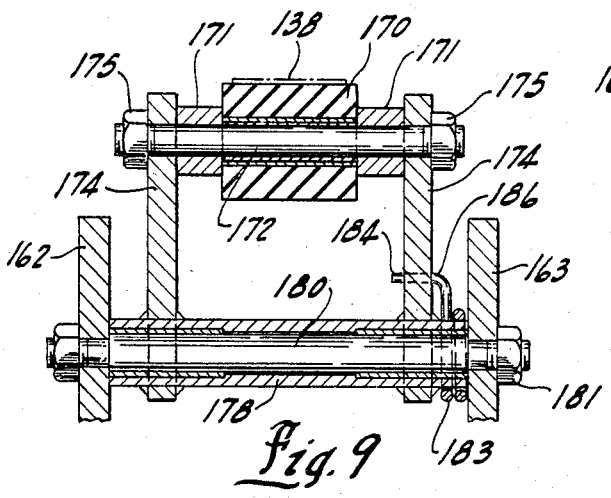
FIG. 9 is a section taken along the line 9—9 of FIG. 8 showing the tape applying roller.

Roller 170 and its support structure are shown in FIG. 9 where it can be seen that roller 170 and a pair of spacers 171 is rotatably mounted on a shaft 172. Shaft 172 passes through a pair of elongate plates 174 and is secured thereto by nuts 175. Plates 174 are in turn welded or otherwise rigidly attached to a cylindrical collar 178 which surrounds and is free to revolve around a shaft 180 located intermediate walls 162 and 163 and secured thereto by nuts 181. The final part of this component of tape head 120 is a spring 183 wrapped around collar 178 and having two ends 184 and 185. First end 185 extends tangentially from the spring coil 183 and contacts the end wall 150 of housing 122. The second end 184 also extends tangentially from the coil but includes a right angle bend 186 which passes around one of the elongate plates 174. The arrangement is such that the spring 183 urges the plates 174 toward a vertical position and spring forces resist downward rotation of roller 170 about the axis of shaft 180. Movement of plates 174 is restrained by a rod 187 mounted between walls 162 and 163 at a location which is spaced apart from and above shaft 180, so that in the normal position, plates 174 form an angle of approximately 35°–45° from the vertical.

As mentioned previously, the tape 138 passes around roller 170 and is assisted in such passage by a guide flap 189 which as affixed to rod 189 and is about the width of the tape 138. Flap 189 is curved upwardly and inwardly from rod 187 so that the tape is urged in a direction which is perpendicular to end wall 150. Since the non-stick side of tape 138 contacts roller 170, no particular attention need by paid to the surface characteristics of this roller, but because the sticky side of tape 138 does contact flap 189, it is preferably made of steel.

Figure 10:
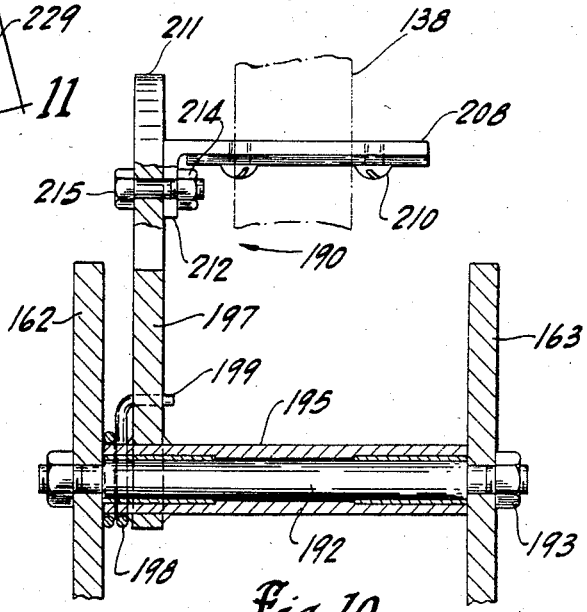
FIG. 10 is a section taken along the line 10—10 of FIG. 8 showing the spring loaded cut-off knife.
Figure 11:
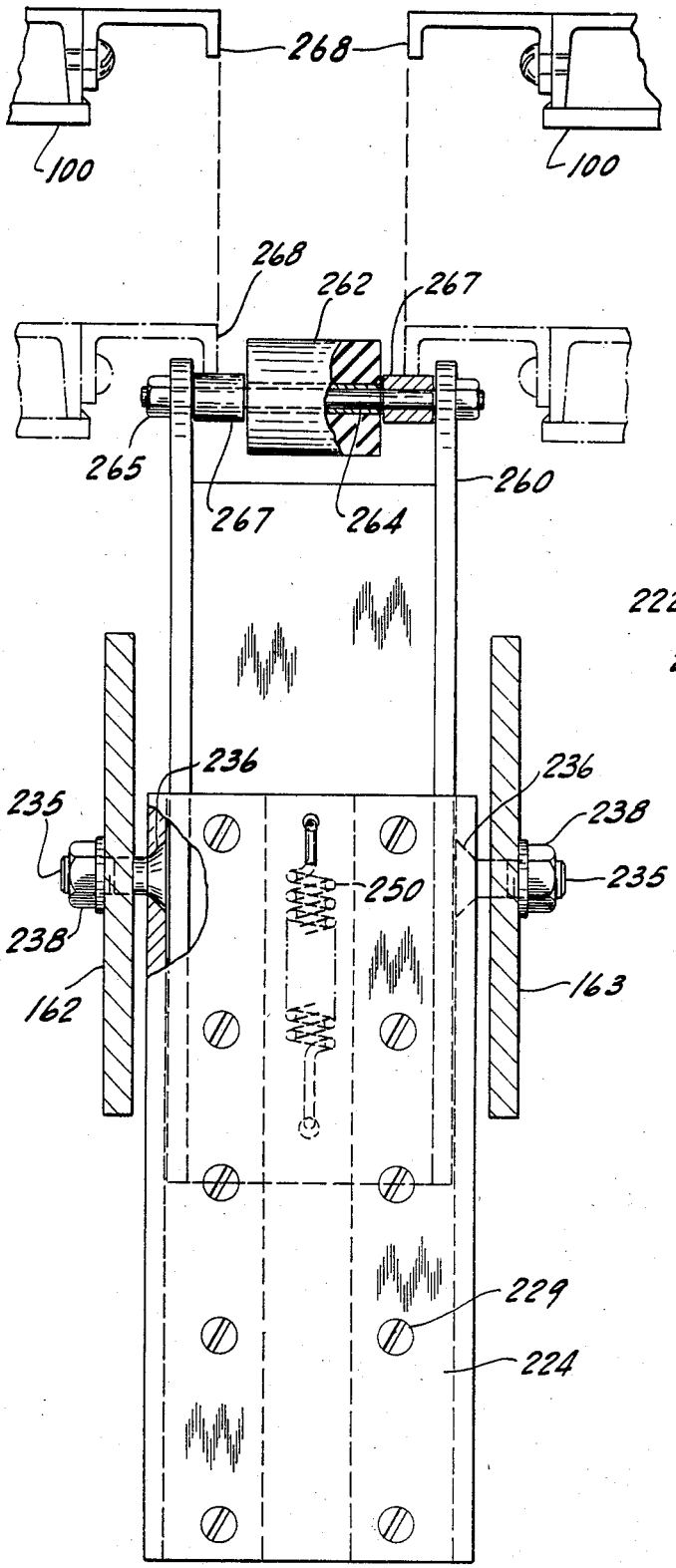
FIG. 11 is a view taken along the line 11—11 of FIG. 8 showing the roller which presses tape on the side and bottom of the box.

Proceeding now to the next component of tape head 120, a spring loaded knife 190 is also provided (see FIG. 10). In many ways, this element is similar in construction to that for spring loaded roller 170. It also includes a shaft 192 secured between sidewalls 162 and 163 by nuts 193. A cylindrical collar 195 rotatably surrounds this shaft and supports a single elongate plate 197 which is similar to but slightly longer than plates 174. Shaft 192 is located intermediate shafts 168 and 180. Plate 197 is located near wall 162 in the illustrated embodiment. While only a single plate is shown here, two plates could also be used. Plate 197 is also spring loaded by coil spring 198 having one end 199 bent around plate 197. The other end 200 of spring 198 rests against collar 178. The knife component 190 is urged toward the vertical by spring 198. It too is restrained to about a 35°–45° angle from the vertical by yet another rod 205 located above shaft 192 and near the top of housing 122. The rod is fixed between the sidewalls 162 and 163.

A replacable knife blade 207 is supported at the free end of plate 197. Blade 207 is generally planar and has two holes therein for securing blade 207 to a blade support 208 by the use of a pair of screws 210. A curved metal plate 211 is attached to arm 197 and extends upwardly above knife 207. Support plate 208 includes a right angle bend 212 at one end which is attached to plate 197 by nut 214 and bolt 215. If desired, the holes in blade 207 can be in the form of slots to allow precise positioning of the blade tip, it being desired that the top of knife blade 207 be at a just slightly higher level than the top of roller 170 when both the knife 190 and roller 170 are resting against their respective stop rods 205 and 185. The knife tip is located inwardly about one inch from the top of roller 170.

Figure 12:
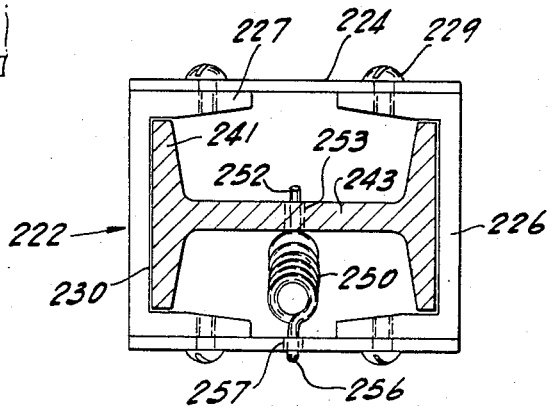
FIG. 12 is a view taken along the line 12—12 of FIG. 8 showing another view of the latter roller.

Finally, at the end of housing 122 which is opposite from end 150 a spring loaded follow roller assembly 220 is provided. This assembly is shown best in FIGS. 8, 11 and 12. Assembly 220 includes a lower slide box 222 which is composed of a pair of rectangular metal plates 224 which form the inner and outer surfaces of box 222 and a pair of elongate side guide members 226. The latter are generally U-shaped with flat sides and ends 227 perpendicular thereto. Sides 227 are screwed to plates 224 with screws 229 so that a hollow box of rectangular or square cross-section is formed as is shown in FIG. 12. The side guide members 226 are spaced apart from one another in the illustration but this is not critical to the invention. What is important is that a slide surface 230 be present, which in the preferred embodiment consists of the inside surface of member 226 between ends 227.

Box 222 is mounted so that its upper end 232 is located just above the center line of housing 122 and the box 222 is tilted off the vertical so that its lower end 233 is approximately below shaft 168. Box 222 is held in place by a pair of bolts 235 extending through holes 236 near the upper end of side guide member 226 and secured to sidewalls 162 and 163 of housing 122 by nuts 238.

Received within box 222 is a generally H-shaped elongate roller support member 240, the cross section of which is shown in FIG. 12. It includes a pair of sides 241 having an outside surface adapted to slide along surface 230 of box 222 and a bridging central span 243. Support member 240 is then free to slide up and down within box 222. A spring 250 is provide to limit such movement, one end 252 of which is looped through a hole 253 in span 243 and the other end 256 of which is looped through a hole 257 in the outer rectangular plate 224.

The span 243 in the upper end of support member 240 is eliminated to form a pair of parallel and spaced apart plate ends 260. Yet another roller 262 is rotatably mounted therebetween on a shaft 264 secured to plates 260 by nuts 265. Spacers 267 are provided between the roller 262 and plates 260.

Roller 262 is also made from a compressible material, such as rubber, and it will also be appreciated from FIG. 8 that roller 262 is normally located several inches higher than roller 170 and knife blade 207. It should also be appreciated, however, that downward pressure on spacers 267 will cause support 240 to be compressed into box 222 against the spring pressure of spring 250. Moreover, it should be apparent from the foregoing description that release of such pressure will cause roller 262 to snap upwardly to the position shown in FIG. 8.

Now that the components of tape heads 120 have been described, the taping sequence can now be described. The sequence will be explained starting with the four tape heads 120 in the position shown in FIG. 3. In this configuration, roller 170 and the knife 207 are in their most upright positions, as is roller 262. As mentioned previously, when the tape heads move inwardly, they do so before the lowering of box support plate 100. After they have moved in, the three movable components of housing 122 are in the same position as shown in FIG. 3. However, when support plate 100 is lowered, the edges 268 thereof which define the slots 104 push downwardly on spacers 171 and 267 and on plate 211 so that the FIG. 6 configuration is reached. Due to the planar nature of the bottom of box 18, rollers 170 and 262 are pushed downwardly against the resistance of their respective springs to cause pressure contact between such rollers and the bottom of the box 18.

By reference to FIG. 8, it can also be seen that a short piece of tape 270 (an extension of the tape 138) is present between roller 170 and knife blade 207. During the compression leading to the position shown in FIG. 6, this piece of tape is applied to the bottom of box 18, as are similar pieces from each of the other three tape heads. As the tape heads are retracted back toward the position shown in FIG. 7, tape is drawn from roll 124 because piece 270 is now affixed to the box. Knife 207 does not damage tape 138 because the knife edge thereof is spaced from the tape by plate 211. Roller 262 also plays a part in the tape sealing step because it rolls over the tape toward the edge of the box 18 and applies pressure thereto due to the spring pressure of roller 262.

As the movable components of tape heads 120 reach the edge of the box and move outwardly therefrom, the following sequence occurs. First, roller 170 passes over the edge and springs upwardly drawing additional tape from roll 124. The next part to pass the edge of the box will be the knife 207 and as it does so, the upward movement of the knife point severs the tape 138. However, at this point, a length of tape (FIG. 7) has been drawn from the roll 124 and extends outwardly from the edge of the box. It is then pressed against the side of box 18 by roller 262, as that roller extends to its normal position, thereby forming the tape seal 29. Tape heads 120 have thus been fully retracted and apparatus 10 is now ready to raise box 10 and start a new taping and closing process.

The air and electronic controls for apparatus 10 are contained in a pair of panels 280 and 282 located respectively adjacent cabinets 32 and 33. Such controls may be variously embodied.

Apparatus 10 may be readily adapted for different size boxes by proper selection of the spacing of eyes 60 and 62 and/or by adjusting to the piston stroke length or cylinder location for those components which act directly on each box. So while the present invention has been described with reference to a particular configuration, the invention is to be limited only by the claims which follow.

I claim:

1. An apparatus for closing and sealing a box wherein it is desired to apply a plurality of L-shaped pieces of tape to a plurality of locations on the bottom and side of said box, said apparatus comprising:

a support plate means for said box and means for vertically moving said support plate between a first position and a second lower position, wherein said means for vertically moving said support plate means comprises a cylinder means having a piston rod means extending therefrom, said piston rod means being coupled to said support plate means, pressure plate means arranged above said support plate means and means for vertically moving said pressure plate means between a first raised position and a second lowered position;

a tape applying means for simultaneously applying said L-shaped pieces of tape to said box when said support plate means is in its second position, wherein said tape applying means comprises tape supply means and a tape head for each piece of tape to be applied and means for simultaneously moving said heads in a horizontal direction from a first position wherein said heads are adjacent to but spaced laterally from said support plate means when said support plate means is in its second position to a second position wherein said tape heads are located beneath said support plate means wherein said tape heads are each adapted to place a piece of tape on the bottom of a box supported on said support plate means when said support plate means and said tape heads are in their respective second positions and to press each piece of tape toward and around the edge of said box and up onto the side thereof as said tape head is moved from its second to its first position.

2. The apparatus set forth in claim 1 wherein said means for vertically moving said pressure plate means comprises a cylinder means having a piston rod means extending therefrom, said piston rod means being coupled to said pressure plate means.

3. The apparatus set forth in claim 1 wherein said head moving means comprises a cylinder having a piston rod means extending therefrom, said piston rod means being coupled to said tape head.

4. The apparatus set forth in claim 1 wherein each of said tape heads includes a spring loaded tape application roller means, a spring loaded knife means for cutting said piece of tape from said tape supply means and a spring loaded follow roller means for pressing said piece of tape onto the bottom of said box and up onto the side thereof during movement of said tape head from its second to its first position.

5. The apparatus set forth in claim 1 further comprising first conveyor means for conveying an unsealed box to a location intermediate said support plate means and said pressure plate means.

6. The apparatus set forth in claim 5 further comprising second conveyor means for conveying a sealed box away from a location intermediate said support plate means and said pressure plate means.

7. The apparatus set forth in claim 5 wherein said first conveyor means includes means for preventing entry of a second box onto said first conveyor means when a first box is already present thereon.

8. The apparatus set forth in claim 7 wherein said preventing means comprises a means for sensing the presence of a box on said first conveyor means and gate means responsive thereto, said gate means preventing entry of a second box onto said first conveyor means when a first box is already located thereon.

9. The apparatus set forth in claim 8 wherein said sensing means comprises electric eye means.

10. The apparatus set forth in claim 8 wherein said apparatus further comprises means for centering a box placed intermediate said pressure plate means and said support plate means.

11. The apparatus set forth in claim 10 wherein said centering means comprises a plurality of arm means selectively movable between a first position to allow a box to be placed intermediate said pressure plate means and said support plate means and a second position for centering said box in said location.

12. The apparatus set forth in claim 11 wherein said centering means further comprises a guide means surrounding said support plate means and intermediate said first and second positions of said support plate means.

13. An apparatus for closing and sealing rectangular or square telescoping boxes wherein a partially closed telescoping box is to be fully closed and wherein four pieces of sealing tape are to be simultaneously applied to the closed box, on a separate bottom edge thereof and intermediate its corners, and each piece of tape being L-shaped and extending inwardly from said bottom edge along the bottom of the box and upwardly from said edge on the side of said box, said apparatus comprising:

a planar and horizontal support plate means for supporting said box during closing and sealing operations, said support plate means having openings therein to permit tape to be applied to the bottom of a box supported thereon, a first vertically arranged cylinder, piston rod means extending from said cylinder and coupled to said support plate means, and fluid inlet and outlet means for said first cylinder whereby said support plate means may be lowered from a first position to a second position;

a planar and horizontal pressure plate means located in a first position above and spaced apart from said support plate means, the distance between said pressure plate means and said support plate means when the latter is in its first position being greater than the thickness of said partially closed box, a vertically arranged second cylinder means located above said pressure plate means, second piston rod means extending therefrom and coupled to said pressure plate means, fluid inlet and outlet means for said second cylinder whereby said pressure plate means may be lowered from said first position to a second position;

means for conveying said partially closed box onto said support plate means and below said pressure plate means when said support plate means and said pressure plate means are in their first positions;

four tape head means horizontally movable on a surface below the surface defined by said support plate means when said support plate means is in its second position, each of said tape heads being movable from a first location beneath an opening of said support plate means to a second location wherein said tape heads are laterally displaced from the edges of said support plate means, each of said tape head means including a roller means for applying a first end of a piece of tape to the bottom of a box supported on said support plate means and means for applying the remainder of said piece of tape outwardly to the edge of said box and upwardly on the side thereof as said tape head is moved from said first location to said second location.

14. The apparatus set forth in claim 13 wherein said pressure plate means is arranged for pressing against said partially closed box to close same when said support plate means is in said second position.

15. The apparatus set forth in claim 13 wherein said conveying means comprises spaced apart driven conveyor rollers and further comprises sensing means for determining the presence of a first partially closed box thereon, means responsive to said sensing means for preventing entry of a second partially closed box onto said conveying means when said first partially closed box is present thereon.

16. The apparatus set forth in claim 13 further comprising means for positioning said partially closed box on said support plate means.

17. The apparatus set forth in claim 13 further comprising a tape roll for each of said tape heads and wherein each of said tape heads includes a spring loaded tape application roller for applying said first end of said piece of tape to the bottom of said box, a spring loaded knife for severing said piece of tape from said tape roll during movement of said tape head from said first to said second location and a spring loaded follow roller assembly arranged for rolling across and pressing said piece of tape to said bottom and to the side of said box.

18. An apparatus for applying elongate pieces of sealing tape to the bottom and the sides of a box to seal same, each of said pieces of tape extending perpendicularly from a point inwardly of a bottom edge of said box toward and around said edge and upwardly on the side of said box, said apparatus comprising:

a support plate means for said box, said support plate means having an elongate opening therein for each piece of tape to be applied to said box, said opening extending perpendicularly from an inward location on said support plate to the edge thereof;

means for holding a box on said support plate means;

a tape head means for each piece of tape to be applied to said box means, a support track means for each of said tape head means, said support track means being located in a plane which is parallel to the plane of said support plate means but spaced apart and below same whereby the upper surface of said tape head means lies in a plane below the bottom of said support plate means, tape supply means for each of said tape head means, means for moving said tape head means along said support track means from a first location in which each of said tape head means lies below an opening of said support plate means to a second location where said tape head means are laterally displaced from the edges of said support plate means, the upper surface of said tape head means moving below said openings of said support plate means during such movement;

roller means extending from the upper surface of said tape head means to apply a first end of said piece of tape to said box and through said opening;

means extending from the upper surface of said tape head means to sever said piece of tape from said tape supply means; and second roller means extending from the upper surface of said tape head means to roll across and press said piece of tape onto the bottom of said box when said tape head means is moved from said first to said second location and said second roller means being spring loaded and extending upwardly from the upper surface of said tape head means when said tape head means passes from underneath said support plate means whereby said second roller means presses said piece of tape around the edge of said box and upwardly onto the side thereof.

19. The apparatus set forth in claim 18 wherein said tape head moving means comprises a cylinder means having a piston rod means extending therefrom, fluid inlet and outlet means on said cylinder means to extend and retract said piston rod means from said cylinder, said piston rod means being coupled to said tape head means.

20. A tape head for applying an elongate piece of tape to an article having a first planar surface and a second planar surface perpendicular thereto and forming an edge therewith wherein it is desired to apply an L-shaped piece of tape onto both planar surfaces and around the edge of said article, said tape head comprising:

a housing having an open top, a first roller means extending from said housing and through said top, said first roller means being spring loaded whereby downward pressure of the article to be taped on said roller forces said roller means toward the interior of said housing against spring forces;

knife means extending from said housing and through the top thereof and adjacent to said first roller means, said knife means being spring loaded whereby said downward pressure on said knife means forces said knife means toward the interior of said housing against spring forces; and follow roller means extending from said housing and through the top thereof and adjacent to said knife means, said follow roller means being spring loaded whereby said downward pressure on said follow roller means forces said follow roller means toward the interior of said housing means and wherein said follow means normally extends from the top of said housing by a distance which is greater than that of said first roller means or said knife means.

* * * * *